United States Patent [19]

Brock et al.

[11] 4,411,207

[45] Oct. 25, 1983

[54] YARN SAVING METHOD AND APPARATUS

[75] Inventors: James D. Brock, Chattanooga, Tenn.; Gerald B. Morrison, Dalton, Ga.

[73] Assignee: Tuftec, Inc., Dalton, Ga.

[21] Appl. No.: 370,981

[22] Filed: Apr. 22, 1982

[51] Int. Cl.[3] ..... D05C 15/32; D05C 15/28

[52] U.S. Cl. ..... 112/79 A; 112/79 R

[58] Field of Search ..... 112/79 A, 79 R

[56] References Cited

U.S. PATENT DOCUMENTS

| | | | |
|---|---|---|---|
| 3,095,841 | 7/1963 | Ballard et al. | 112/79 R |
| 3,301,205 | 1/1967 | Card | 112/79 R |
| 3,396,687 | 8/1968 | Nowicki | 112/79 A |
| 3,605,660 | 9/1971 | Short | 112/79 A |
| 3,847,098 | 11/1974 | Hammel | 112/79 A |
| 3,926,132 | 12/1975 | Lear et al. | 112/79 A |
| 3,934,524 | 1/1976 | Smith | 112/79 A |
| 4,134,348 | 1/1979 | Scott | 112/79 R |
| 4,173,192 | 11/1979 | Schmidt | 112/79 R |

*Primary Examiner*—Ronald Feldbaum
*Attorney, Agent, or Firm*—Jones & Askew

[57] ABSTRACT

A yarn saving apparatus for conventional tufting machines which includes means for sensing the lateral movement of a needle bar or other laterally shiftable patterning device, and means responsive to the lateral movement of the needlebar or other lateral shifting device for slowing the speed at which yarn is fed to the outermost groups of needles of the needle bar, thereby withdrawing yarn from loops formed thereby, so as to prevent wastage of the yarn which would otherwise be tufted into a wastage area at the outer longitudinal border of the carpet backing. Yarn is provided to the groups of tufting needles at the normal rate when the tufting needles are positioned over an area which is to be tufted, and yarn is provided to the groups of tufting needles at a slower rate which effectively withdraws yarn from loops in the wastage area when the groups of needles are positioned over the wastage area.

13 Claims, 10 Drawing Figures

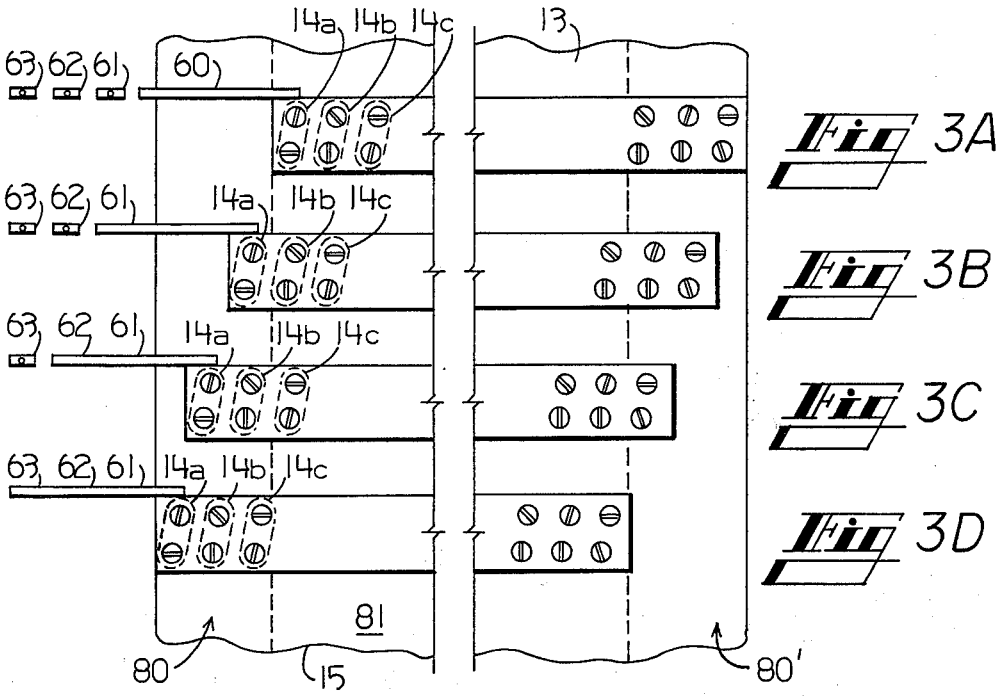
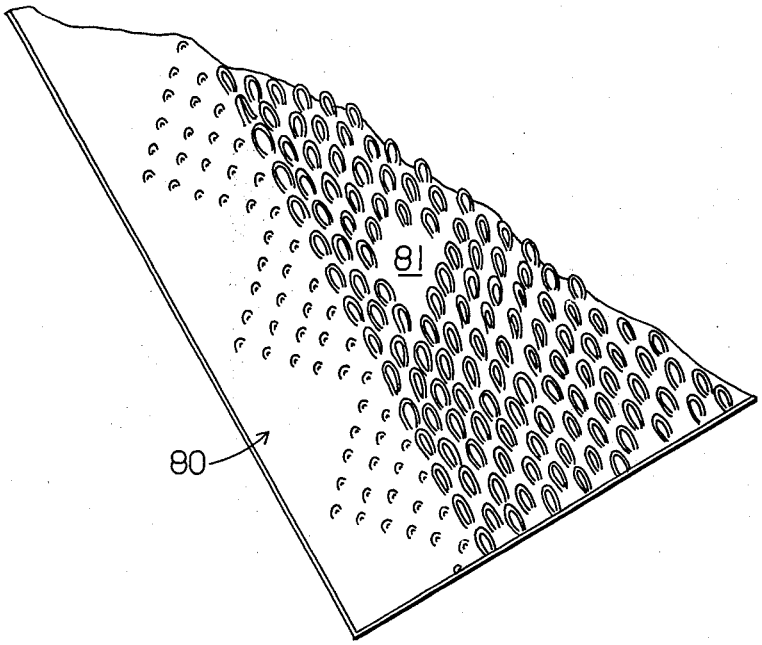
Fig 6

YARN SAVING METHOD AND APPARATUS

BACKGROUND

1. Field of the Invention

The present invention relates generally to improvements for tufting machines, and specifically relates to a yarn saving apparatus for tufting machines which inhibits the tufting of a carpet backing web along its outer longitudinal borders by selectively withholding yarn from selected outer groups of needles of a shiftable needle bar, thereby reducing the wastage of yarn which otherwise would be tufted onto the longitudinal borders and cut off when the carpet is trimmed to remove the borders.

2. Description of the Prior Art

In the tufting of pile fabrics, and particularly carpets, a series of needles are often positioned in a needle bar to carry pile yarns through a backing web or fabric which is advanced over a throat which receives the needles as the web is penetrated. Oscillating loopers positioned underneath the throat engage loops of pile yarn to hold the yarn as the needles are withdrawn, and oscillating knives may be positioned to provide cut pile, if desired.

Many conventional tufting machines often employ laterally shiftable mechanisms for repetitively changing the relative position of the needles and backing web to provide a pattern effect, to eliminate lines or streaks in the fabric which are especially noticeable with multicolored yarns, and to break up the noticeable alignment of longitudinal rows of tufting that detract from the appearance of the carpet. Some of these mechanisms are shiftable needle bars, while others include shiftable backing web carriers. For example, U.S. Pat. Nos. 3,109,395 to Batty, 3,203,388 to Parlin, 3,964,407 to Ingram et al., 3,301,205 to Card, 3,026,830 to Bryant, and 3,964,408 and 3,972,295 to Smith disclose various mechanisms which shift the needle bar laterally as the needle bar is reciprocated toward and away from the web to cause the needles mounted on the needle bar to penetrate the web.

Generally, only a limited amount of lateral shifting is possible in shifting mechanisms due to physical limitations on the length of the needle bar or on the parameters of cam devices which are commonly employed to effectuate shifting. It is quite common to find that the relative shift between the backing web and the needles is limited to less than about six gauge spaces, that is, lateral spaces between needles. In such devices, the pattern effect produced adjacent to the outer longitudinal border of the backing web is a "wave line" of tufting, or a wave of tufted area which borders on a non-tufted portion of the backing web immediately adjacent to the longitudinal border of the backing web. For example, FIG. 28 of U.S. Pat. No. 3,249,078 to Nowicki and FIG. 6 of U.S. Pat. No. 3,203,388 to Parlin, the disclosures of which are incorporated herein by reference, show wave lines of tufting from the top surface and undersurface, respectively, of carpets which have been laterally shifted a plurality of gauge spaces. It will be understood that the lateral shifting occurs across the entire transverse width of the backing web, and that the wave line itself is most apparent only at the outer longitudinal borders of the backing web which are tufted by groupings of needles at the ends of the needle bar.

In order for the carpet to be commercially saleable, the wave line of tufting on the outer longitudinal border of the backing, together with the non-tufted portion of the backing web adjacent to the edge of the carpet (collectively, the "wastage area") must be cut off. Inevitably, there is wastage of both tufting yarn and of backing web material. It is highly desirable for the patterning effects, streak elimination, and row alignment breakup which result from lateral shifting to dominate the carpet, yet it is also desirable to eliminate the wastage of yarn which is also a result of the shifting. No prior art devices appear to provide a solution to the problem of wastage while maintaining the beneficial effects of lateral shifting.

It is known in the art that various pattern effects can also be produced by varying the height of the loop of pile yarn. Various methods have been proposed for controlling the height of the loop. For example, U.S. Pat. No. 3,249,078 to Nowicki discloses a method for tufting which combines lateral shifting of a needle bar with pile height control by a "bar type" pattern attachment yarn feed mechanism such as that shown in U.S. Pat. Nos. 2,853,033 and 2,853,034 to Crawford. Nowicki, U.S. Pat. No. 2,912,945, discloses a pattern attachment for tufting machines which controls pile height by means of a contoured feed roller. Methods for making high and low level pile heights for patterning by selective tensioning or locking of the yarn being fed to the tufting needles are taught in U.S. Pat. Nos. 2,876,183 to Parlin, 2,876,441 to Boyles, 2,842,079 to Rice, 2,782,905 to Smith, 2,940,405 to Parlin, 3,334,601 to Ellison, 3,110,276 to Penman, 2,866,424 to Masland, and 2,912,945 to Nowicki.

Control of pile height may also be achieved by a related technique in which yarn is fed to tufting needles by a speed control apparatus which selectively feeds yarn at a first rate which produces a tuft of a given height, or at a second rate, slower than the first, which produces shorter tufts than the tufts of the given height. For example, Nix, U.S. Pat. No. 2,875,714 shows that high and low loops can be formed by feeding the pile yarns over high speed and low speed rollers which alternately provide "full feed" and "starving feed" to groups of tufting needles thereby forming alternate rows of high and low pile loops. U.S. Pat. Nos. 2,862,465 to Card, 4,193,358 to Woodcock, 2,880,684 to Masland, 3,263,631 to Freeman, 2,966,866 to Card and 2,954,865 to Hackney teach that pile height may be controlled in this manner. In these patents, different heights of pile loops occur because the amount of yarn fed at the slower rate is insufficient to form a loop corresponding to the maximum depth of needle penetration, causing yarn withdrawal or "robbing" from a previously formed loop. By selectively controlling the rate of yarn feed, patterns having varying yarn height can be tufted.

No known prior art devices, however, disclose any methods or devices which allow patterning across the transverse width of the backing but which may be coordinated with the lateral shifting of the needle bar so that yarn robbing, tensioning, or withdrawal occurs only at the outer longitudinal edges of the backing web independently of any patterning control. If tufting can be inhibited or prevented at the edges when the needle bar extends over the wastage area independently of the patterning, the yarn which would otherwise be wasted as the outer groups of needles tuft the wastage area can be saved.

SUMMARY OF THE INVENTION

The present invention is an improvement to conventional tufting machines which saves the yarn which would otherwise be tufted in the wastage area. The present invention includes means for sensing the lateral shifting of the needle bar and means responsive to the lateral movement of the needle bar for slowing the speed at which yarn is fed to the outer groups of needles near the ends of the needle bar when the ends of the needle bar are shifted over the wastage area. The preferred embodiment described herein is directed toward application of the present invention in a tufting machine having a laterally shiftable needle bar, but it will be understood that the present invention is adaptable for use in tufting machines which provide lateral shifting of the backing web relative to a laterally fixed reciprocating needle bar.

More particularly described, the present invention slows the speed at which yarn is fed to the outer groups of needles so that only the groups of needles over the no-tufting or wastage area are affected. As the needle bar shifts the outer-most group of needles nearest the end of the needle bar over the wastage area, yarn is fed at a slow rate only to this outer group of needles. The remainder of the needles are fed at the normal rate, or at a rate determined by a patterning device, as desired. On a subsequent shift of the needle bar in the same direction, the outer-most group of needles and the group of needles immediately adjacent to the outer-most group of needles will be positioned over the wastage area, and the yarn is fed at a slow rate to both of these groups of needles. Yarn is fed at the slow rate only during the periods of time in which both groups of needles are in the wastage area. As the needle bar is shifted in the opposite direction to remove needles from the wastage area and placed them back in the tufting zone, yarn is restored to the full feed rate so that tufting is restored to normal.

In order to provide for the selective feeding of yarn to groups of needles which are shiftable over the wastage area and the tufting area, each group of needles is provided with a separate yarn feed mechanism independent of any patterning device. In the preferred embodiment, the yarn feed mechanism comprises a pair of yarn feed rollers which are geared to rotate together. One of the pair of the rollers turns about a first drive shaft, while the other roller turns about a second drive shaft. The first drive shaft rotates at the normal speed at which the yarns are fed in order to provide a normal pile height. The second drive shaft rotates at a slower speed than the first drive shaft.

The yarn feed rollers may be selected to rotate at the speed of either the first drive shaft or the second drive shaft. Each one of the pair of yarn feed rollers includes a clutch which may be engaged to the shaft about which the roller turns. The two clutches for the pair of rollers are selectively engageable so that the geared-together rollers may engage either the first drive shaft or the second drive shaft, but not both simultaneously. Thus, both rollers rotate and feed yarn at either the rate of the first drive shaft or the rate of the second drive shaft, depending upon which clutch is engaged.

The clutches are controlled by control means which are responsive to the lateral position of the needle bar. Each group of needles is associated with a pair of feed rollers as described, and the yarn provided to such group of needles passes between the feed rollers so that the yarn is fed either at the fast rate or the slow rate, depending upon which clutch is engaged. When the group of needles is over an area of the backing which is to be tufted with pile of a normal height, the control means engages the clutch on the first shaft so that yarn is fed at the faster rate, thereby forming pile loops of a normal height. When the sensing means determines that the group of needles has laterally shifted over the wastage area, the clutch to the first drive shaft is released and the clutch to the second, slower drive shaft is engaged. The feed roller on the first drive shaft then idles or "free wheels," and yarn is then provided to the group of needles at the slower rate. Yarn robbing or withdrawal then occurs because the needles are starved of yarn, and wastage is eliminated.

Accordingly, it is an object of the present invention to provide an improvement for tufting machines.

It is another object of the present invention to provide an improvement for tufting machines which conserves yarn.

It is another object of the present invention to provide an apparatus and method for conserving yarn in a tufting machine by selectively feeding yarn to groups of needles on a needle bar at a slower, loop-starving rate when such groups of needles are laterally shifted over a wastage area of backing web which is normally cut off prior to commercial sale of the carpet.

It is another object of the present invention to provide an apparatus and method for conserving yarn in a tufting machine which operates independently of any patterning devices which may be included with such machine.

These and other objects, features, and advantages of the present invention may be more clearly understood and appreciated from a review of the following detailed description of the disclosed embodiments and by reference to the appended drawings and claims.

BRIEF DESCRIPTION OF THE DRAWINGS

FIG. 3 is an illustration demonstrating various lateral positions of a needle bar over tufting and no-tufting zones.

FIG. 6 is a partial diagrammatic illustration of carpeting produced by a tufting machine employing the present invention.

DETAILED DESCRIPTION OF THE PREFERRED EMBODIMENT

Figure 1:
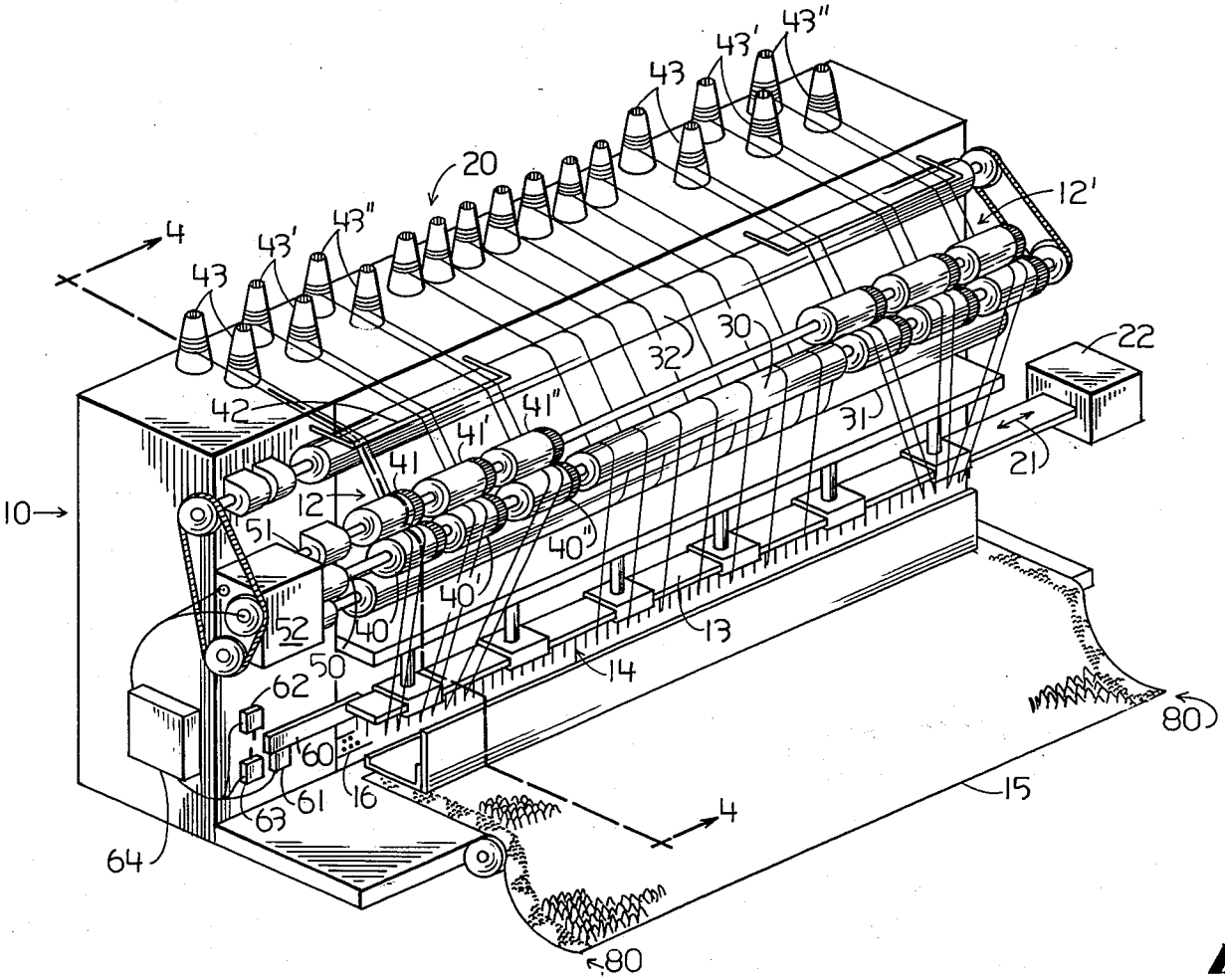
FIG. 1 is a perspective diagrammatic view of a tufting machine which incorporates a preferred embodiment of the present invention.

Referring now to the drawings, in which like numerals indicate like elements throughout the several views, FIG. 1 shows in diagrammatic form a tufting machine 10 which incorporates a pair of preferred embodiments 12, 12' of the yarn saving apparatus of the present invention. The tufting machine 10 is of conventional construction and comprises a needle bar 13 containing a plurality of needles 14 reciprocable toward and away from a backing web 15 which is tufted with piles of yarn. A needle receiving throat 16 receives the needles when the web is penetrated by the needles. Throat 16 is positioned beneath needle bar 13 and contains a plurality of precisely spaced openings of a diameter sufficient to receive the needles 14 when the needles pass through the backing. The openings are aligned so that when the needle bar shifts laterally transversely all needles will be received in respective openings in the plate.

Loopers or hooks 78, 79 (shown in FIG. 1) are positioned beneath throat 16 so as to hook the yarn loops thrust through the backing when the backing is penetrated.

be understood that each needle of needle bar 13 is provided with an independent source of yarn from bobbins 20 mounted on or near the tufting machine.

Needle bar 13 is laterally shiftable across the transverse width of the backing web 15 in the direction shown by arrow 21 to provide a pattern effect, or to eliminate lines or streaks in the fabric which are caused by the noticeable alignment of rows of tufting or an out-of-tolerance particular yarn. The lateral movement of the needle bar is controlled by a conventional needle bar shifting device 22 which is known in the art. As will be described further hereinbelow, needle bar 13 shifts groups of needles in steps. In the tufting machine shown in FIG. 1, the needle bar is shiftable a total of three steps, there being two needles in each group of needles comprising a step, so that a total of up to six needles, in three groups of two needles, are shiftable over wastage areas 80 extending along the longitudinal borders of the carpet backing web 15.

A primary yarn feed roller 30 (shown at less-than-normal length in FIG. 1) provides yarns to all of the needles on needle bar 13 with the exception of the outer most groups of needles on either end of the needle bar. The yarns are provided from yarn bobbins 20, over a bobbin roller 32, a primary feed roller 30, and a secondary feed roller 31. Feed rollers 30, 31 and 32 rotate at the same speed and thus provide yarn to the majority of needles at a constant rate. Those skilled in the art will appreciate that pattern control devices or other means for providing yarn to the tufting needles may also be employed to control the rate and quantity of yarn fed to the needles.

The yarns to the outer groups of needles at the ends of the needle bar are provided separately from those yarns provided over primary feed roller 30, since these yarns must be controlled by the present invention in order to effectuate yarn conservation. There are two yarns provided to each group of two needles corresponding to a step of shifting movement of the needle bar. Each pair of yarns is associated with a pair of rollers which draw the yarn from a particular pair of bobbins. For example, in FIG. 1, the pair of yarns to the outer-most pair of needles at the end of needle bar 13 is provided over a first roller 40 which is mounted coaxially with the primary feed roller 30. The yarns are provided by a pair of bobbins 43, over a feed bar 42, and then pass between the first roller 40 and a second roller 41. In a similar fashion, yarns to a second group of two needles positioned adjacent to and one step inwardly from the outer group of needles is provided by a pair of bobbins 43', over feed bar 42, and pass between a first roller 40' and second roller 41'. Similarly, the pair of yarns associated with the group of two needles positioned adjacent to and inwardly from the second group of needles is provided from a separate pair of bobbins 43" and over feed bar 42, and pass between a first roller 40" and a second roller 41".

Feed bar 42 prevents the yarns guided thereby from contacting the bobbin roller 32 and thus allows those yarns to be independently speed-controlled. A yarn guide, yarn feed tubes, or the like may also be used to draw yarns from particular selected bobbins to be provided to the first and second rollers comprising the present invention.

An actuator bar 60 is attached horizontally to the needle bar 13 and extends transversely outwardly away from the path of the backing web. This actuator bar contacts with and sequentially actuates switches 61, 62 and 63, respectively, and thereby provides means for sensing the lateral movement of the needle bar. The outputs of switches 61, 62, and 63 are provided to a control unit 64 and thence to a series of clutches, shown in FIG. 4, which determine the speed at which yarns will be provided over rollers 40 and 41.

The first rollers 40, 40', 40" are coaxial with and selectively engageable with a first shaft 50. The primary yarn feed roller 30 is firmly fixed to the first shaft 50 and rotates therewith. First rollers 40, 40', 40" are selectively engageable with first shaft 50 by clutches, which will be described below.

Second rollers 41, 41', 41" are coaxial with a second shaft 51 which rotates at a slower speed than shaft 50. The speed reduction for shaft 51 may be provided by a conventional gear box 52 or the like which is attached to the same source of rotary power as that which powers the primary, secondary, and bobbin rollers 30, 31, and 32, respectively. It will be understood that a suitable conventional source of rotary power is provided in the tufting machine. Preferably, the speed of second shaft 51 is adjusted so that the yarns are stretched or tensioned when yarn saving is in effect but not so slow as to cause unthreading of the needles or breakage of the yarns. Thus, this speed will vary with the yarn used.

Figure 2:
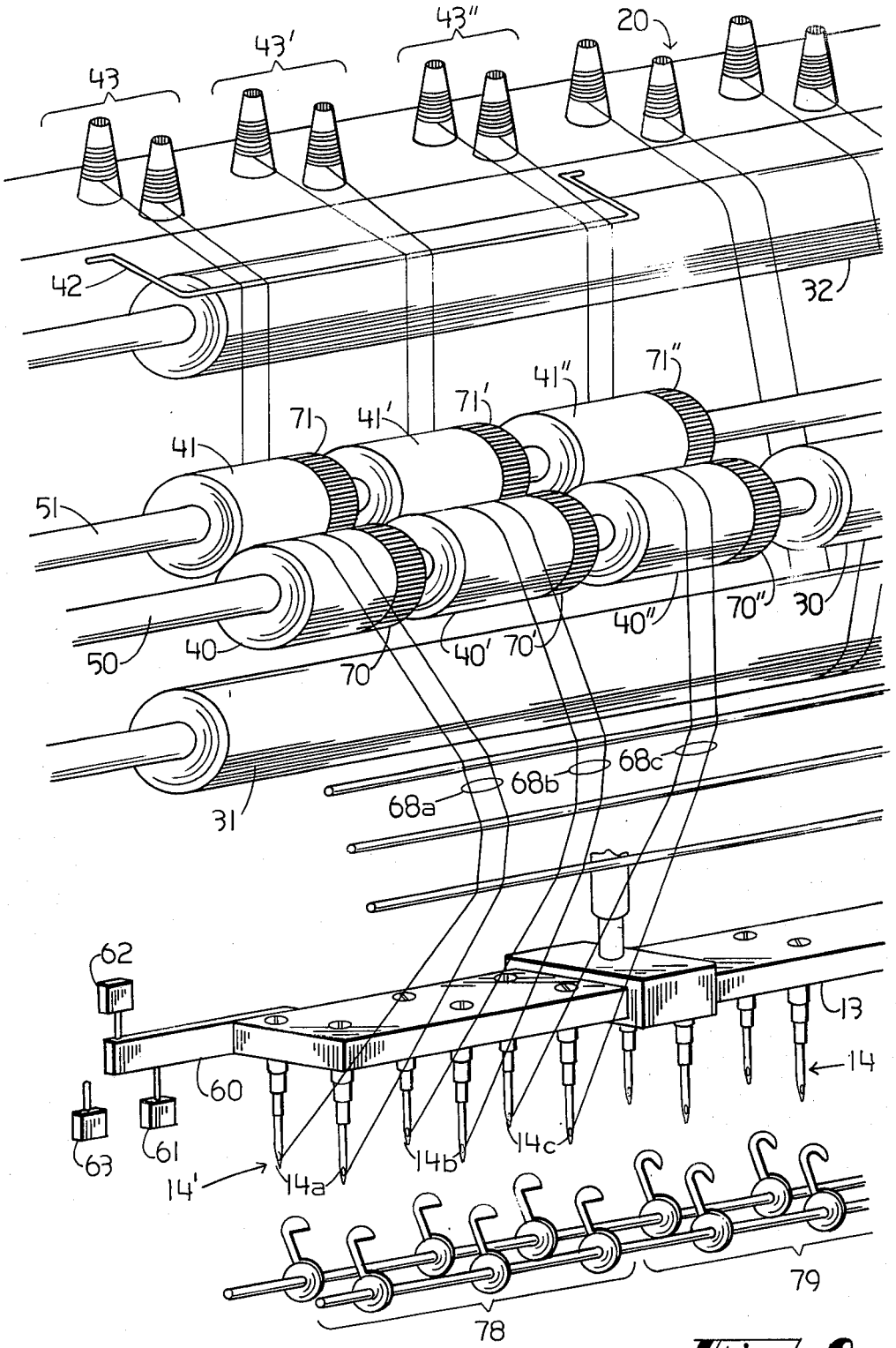
FIG. 2 is an exploded partial diagram of the yarn saving apparatus of the present invention.

Turning now to FIG. 2, it may be particularly seen that needle bar 13 includes two parallel but offset rows of needles 14, 14'. For purposes of describing the present invention, a group of needles includes one needle from row 14 and one needle from row 14'. Thus, each group of needles for which yarn is provided by the present invention includes two needles, so that a pair of yarns must be provided to each group of needles. The outer most group of needles is designated **14*a*, the next inwardly located group of needles is 14*b*, and the most inwardly group of needles is designated 14*c***. It will be understood that more or fewer needles may be included in a group of needles for which the yarn is controlled by the present invention.

The pair of yarns **68*a* associated with needle group 14*a* is provided by bobbins 43, over feed bar 42, over first roller 40 and under second roller 41**.

As described above in connection with FIG. 1, first roller 40, as well as rollers 40' and 40", are coaxial with first shaft 50 which rotates at a first or normal speed. Primary yarn feed roller 30, being rigidly affixed to first shaft 50, thus provides yarns to all needles at such first rate of feed with the exception of those needles for which yarn is provided over rollers 40, 40' and 40".

Second roller 41 is coaxial with second shaft 51. A gear 70 associated with first roller 40 is intermeshed with a gear 71 that is associated with second roller 41. Gears 70, 71 insure that rollers 40 and 41 rotate at the same rate, depending on whether the rate of the first shaft or the second shaft is selected. Similar gears 70' and 71', 70" and 71", insure that rollers 40' and 41', and 40" and 41", respectively, rotate at the same rate.

In certain applications it may be desirable that the loopers associated with the outer groups of needles 14a, 14b, 14c be of a different type from the loopers associated with the remainder of the needles of the needle bar. For example, as shown in FIG. 2, if the loopers 78 associated with the outer groups of needles have a flat surface, as opposed to the more hooked type of looper 79 associated with the majority of needles on the needle bar, the loops will not be firmly retained on the loopers 78 and will tend to slip off, thereby permitting loops formed in the wastage area to be pulled substantially out due to the tension on the yarns.

As shown in FIG. 2, actuator bar 60 sequentially actuates switch 61, switch 62, and switch 63 as the needle bar 13 moves in the leftward direction, and then sequentially deactuates switch 63, then switch 62, and switch 61, respectively, in that order, as the needle bar moves in the rightward direction. This motion is more clearly illustrated in FIG. 3, which demonstrates the possible positions of the needle bar as it moves in steps of groups of needles. It will be understood that the needle bar moves from an initial position as shown in FIG. 3A, to that shown in FIGS. 3B, 3C, and then 3D, and then returns in the rightward direction from 3D to 3C, and then to 3B and 3A. The wastage area of the carpet backing web 15 is shown at 80 for the left portion and 80' for the right portion. The area which is commercially saleable after the wastage areas 80, 80' are cut off is indicated at 81.

In FIG. 3A, the needle bar 13 is shown laterally shifted to the rightmost extent of its movement, so that no groups of needles associated with the left end of the needle bar are over the wastage area 80, but all groups of needles associated with the right end of the needle bar are over the wastage area 80' of the carpet backing. In the situation depicted in FIG. 3A, the yarns provided to needle groups 14a, 14b and 14c are provided at the normal rate so that tufts having a normal pile height are formed. In contrast, all yarns provided to the groups of needles at the right end of the needle bar 13 are slowed. Loops formed in the wastage area 80' are pulled out due to tensioning of the yarn provided at the slow rate, thereby conserving yarn. None of switches 61, 62 or 63 are actuated by actuator 60 in this situation.

In the situation depicted in FIG. 3B, the needle bar has shifted one step to the left, so needle group 14a is over the wastage area 80, but groups 14b and 14c are still in the tufting area 81. In this situation, the yarns would be slowed to needle group 14a but would be provided at the normal rate to groups 14b and 14c. Switch 61 is actuated by actuator bar 60 at this time.

In FIG. 3C, needle groups 14a and 14b are over the wastage area 80 and consequently yarn is provided to these groups at the lower or conserving rate. Needle group 14c is provided yarn at the normal rate since it still remains in the tufting area 81. Switches 61 and 62 are actuated at this time.

In FIG. 3D, the needle bar has reached the leftmost extent of its movement wherein switches 61, 62 and 63 are all simultaneously activated. In this case, needle groups 14a, 14b, and 14c all are provided yarn at the slow or conserving rate. Subsequent to the situation depicted in FIG. 3D, the needle bar begins to shift to the right and the sequence is reversed with switches 63, 62 and 61 being sequentially deactuated.

Figure 4:
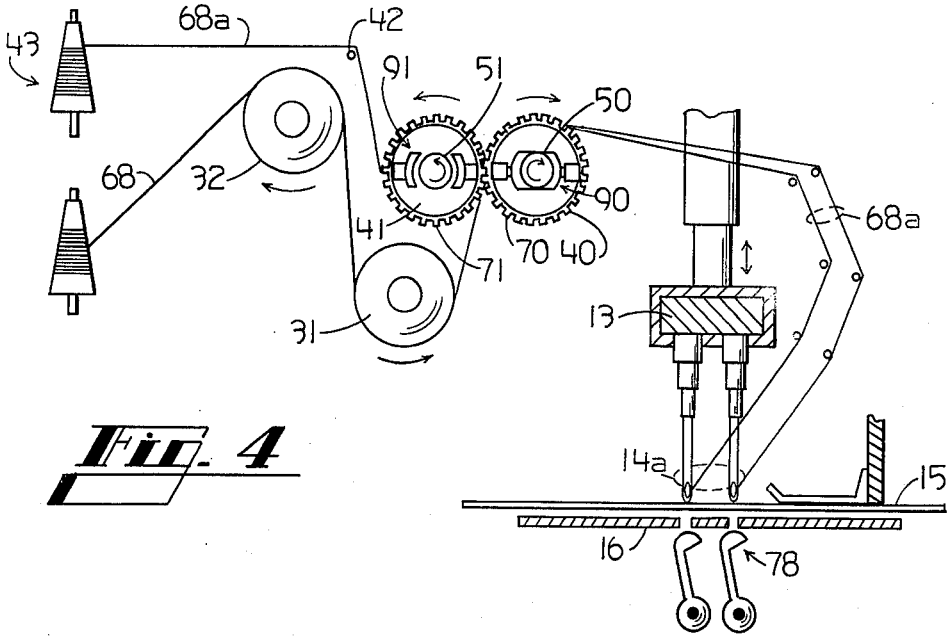
FIG. 4 is a partial cross-sectional diagrammatic view taken along the line 4—4 of FIG. 1.

FIG. 4 is a partial cross-sectional diagrammatic view taken along the line 4—4 of FIG. 4 which shows the threading of the yarns and the clutches which selectively engage shafts 50, 51. The yarns 68a associated with needle group 14a are provided from bobbin 43, over feed bar 42, over first roller 40, and between first roller 40 and second roller 41. The yarns 68 to the needles in the tufting area are provided over bobbin roller 32, under secondary roller 31, and then over primary yarn feed roller 30 (not visible in FIG. 4).

In order to selectively engage the first shaft 50, a first electromagnetic clutch 90 is mounted on the interior circumference of first roller 40 so as to rotate therewith. Power is provided to the electromagnetic clutch through a conventional brush or commutator arrangement (not shown). When clutch 90 is actuated, as shown in FIG. 4, first roller 40 is in frictional engagement with shaft 50 and rotates therewith.

A second electromagnetic clutch 91 is mounted to the interior circumference of second roller 41 and is similarly provided with power through brushes, commutators, or the like. As shown in FIG. 4, second electromagnetic clutch 91 is not actuated. If actuated, second electromagnetic clutch 91 would be in frictional engagement with second roller 41 so as to cause roller 41 to rotate with second shaft 51. Clutches 90, 91 are wired so that only one of the clutches is actuated at any one given time. This wiring arrangement will be described in connection with FIG. 5.

Gear 70, associated with first roller 40, is meshingly engaged with gear 71, associated with second roller 41, so that rollers 40 and 41 rotate at the same velocity, depending upon whether clutch 90 or 91 is actuated. It will be appreciated that yarn provided between rollers 40 and 41 is provided to needle group 14a at either a normal rate or a slower rate, depending upon whether the rollers 40, 41 are selected to rotate at the rate of the first shaft 50 or the rate of the second shaft 51.

Figure 5:
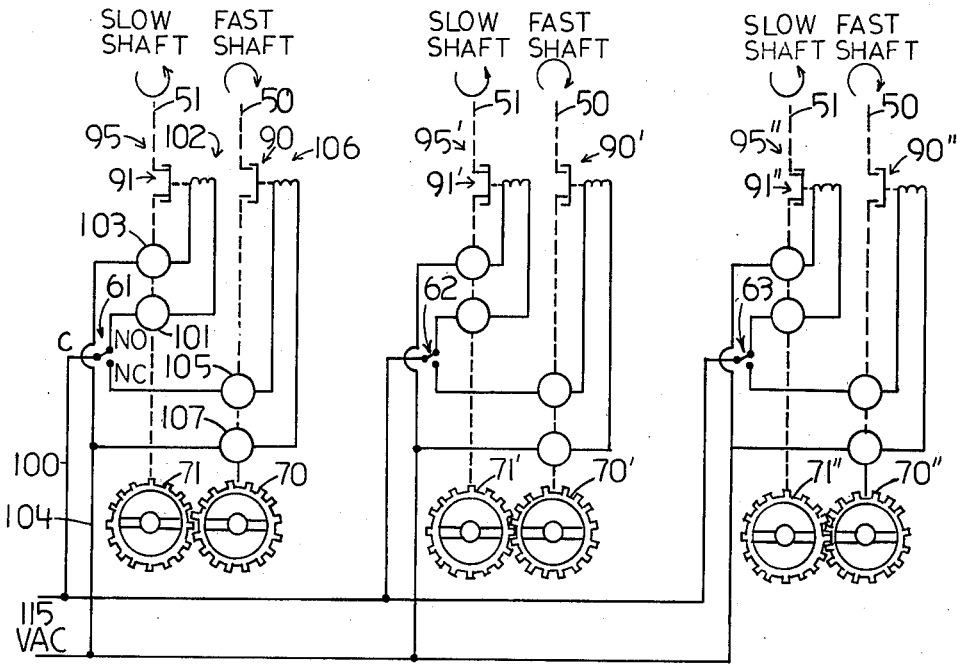
FIG. 5 is a schematic diagram of the control circuitry used in the present invention.

FIG. 5 is a schematic diagram showing the connection of the switches and clutches so as to engage the clutches when the needlebar is shifted to the various positions shown in FIG. 3. These corrections may be made in the control unit 64 of FIG. 1. The circuitry associated with first clutch 90 and second clutch 91, and switch 61, is shown at 95 in FIG. 5. This circuitry controls the rollers which provide yarn to the outermost group of needles 14. It will be appreciated that similar parallel circuitry, as shown at 95', 95" in FIG. 5, is provided for controlling yarns over rollers 40' and 41', and yarns which are provided over rollers 40" and 41", respectively. The circuitry shown in FIG. 5 demonstrates the clutch positions and switch positions which would be expected if the needle bar were shifted to the extreme left, as shown in FIG. 3D. It is in this position that yarn is provided at the slow rate to needle groups 14a, 14b, and 14c.

Electrical power is provided to the circuitry from a conventional source. One line 100 of the power is provided to the common terminal C of switch 61. Switch 61 in the preferred embodiment is a single pole double throw switch having a common terminal, a normally open (NO) terminal, and a normally closed (NC) terminal. When switch 61 is actuated, the normally open terminal closes, so that electrical power is provided from the common terminal to the normally open terminal. Power is thereby provided through a first commutator 101 to one terminal of a coil 102 of electromagnetic clutch 91. The other terminal of coil 102 is provided through a second commutator 103 to a return line 104 which completes the circuit. As thus depicted, the second electromagnetic clutch 91 is engaged which causes rollers 40 and 41, geared together by gears 70 and 71, to rotate at the speed of shaft 51, which is rotating at a speed slower than normal.

When switch 61 is deactuated, which only occurs when the needle bar has been shifted to the position shown in FIG. 3A, power is provided to the normally closed contact, as opposed to the normally open contact. In this situation, electric power is removed from coil 102 and clutch 91 disengages. Power is then provided through a third commutator 105 to one terminal of coil 106 of first electromagnetic clutch 90. The other terminal of coil 106 is provided through a fourth commutator 107 to return line 104, completing the circuit. In this situation, second electromagnetic clutch 91 is disengaged, while first electromagnetic clutch 90 is engaged, thereby causing rollers 40 and 41 to rotate at the normal speed of shaft 50. Thus, yarn is provided to needle group **14*a*** at the higher, normal speed, and loops of yarn are allowed to form to a normal pile height.

It will be appreciated that the operation of the circuits 95', 95'' is the same as that for circuit 95.

FIG. 6 is an illustration of the outer longitudinal border of a carpet which has been tufted with a yarn saving apparatus constructed in accordance with the present invention. As can be seen, the tufting in the tufting area 81 has a normal pile height, while the wastage area 80 contains virtually no loops of any appreciable height because the yarn has been withdrawn due to tensioning of the yarn. Thus, it will be appreciated that substantial quantities of yarn can be saved by use of the present invention.

Figure 7:
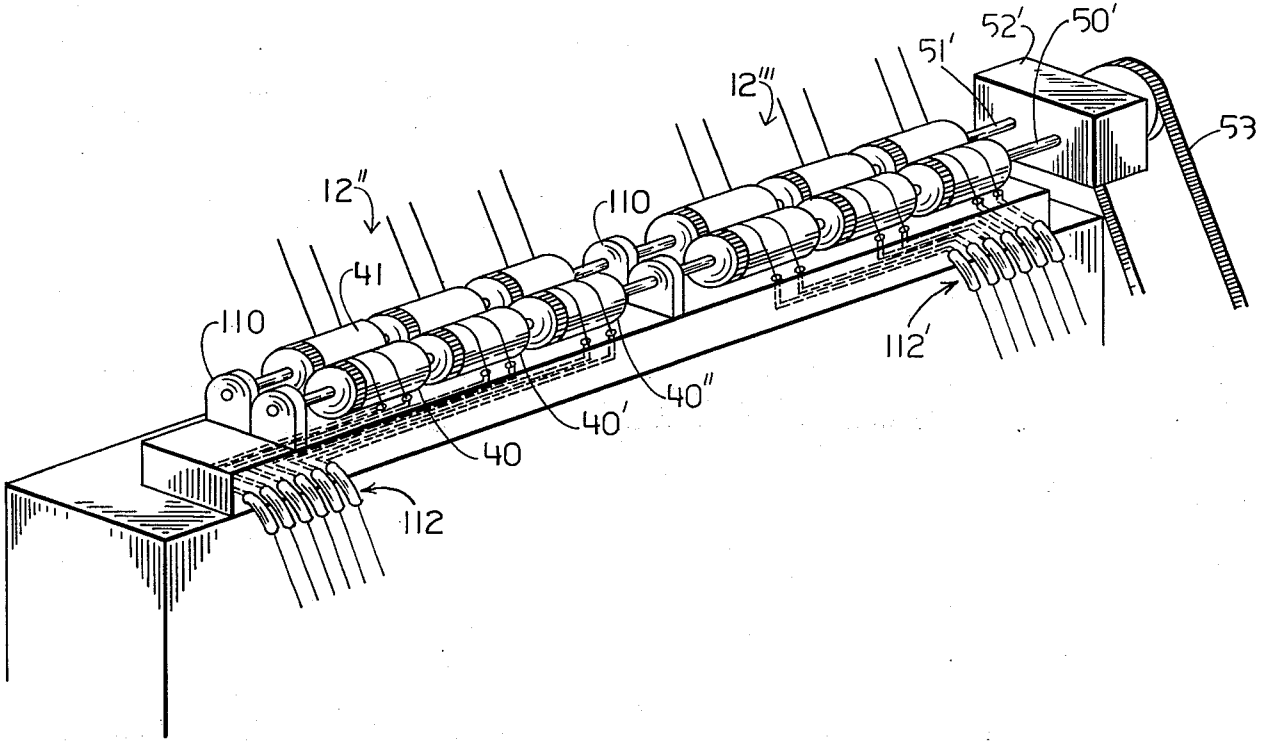
FIG. 7 is a perspective view of a second preferred embodiment of the present invention which may be used to retrofit existing tufting machinery.

FIG. 7 is a perspective illustration of a second preferred embodiment of the preferred invention which may be retrofitted to existing tufting machinery. It is contemplated that the apparatus may be mounted at a location proximate to the tufting machine, such as on the top near the yarn supply bobbins. The second preferred embodiment comprises a plurality of rollers 12'' associated with one end, such as the left end, of a needle bar (not shown), and a second set of rollers 12''' associated with the right, or opposite end of the needle bar. A gear box 52' receives rotary power from a chain, belt, or the like 53 and provides rotary power at two different speeds. A first shaft 50' rotates at a first or normal rate which is intended to be the same rate as the rate at which yarns are normally fed to the tufting needles. A second shaft 51' is attached to gear box 52' and rotates at a second rate which is slower than the first rate.

The shafts 50', 51' are journaled in bearings which are supported by conventional mountings 110 for parallel rotation.

A plurality of first rollers 40, 40', 40'' which contain selectively engagable electromagnetic clutches are mounted coaxially with shaft 50' for rotation therewith. A plurality of second rollers 41, 41', 41'' are mounted coaxially with shaft 51' and contain electromagnetic clutches which selectively engage the second rollers to the shaft 51'. Each pair of rollers 40, 41 are engaged by gears as in the case of the first preferred embodiment. The yarns provided over any given pair of rollers 40, 41 are provided to the respective needles through a network of yarn feed tubes 112 which direct the yarns from the rollers to the needles. As shown in FIG. 7, yarn feed tubes 112 provide the yarns to the groups of needles associated with the left end of the needlebar, while yarn feed tubes 112' provide yarns to the right end of the needle bar. The entire assembly, which includes the network of yarn feed tubes, rollers, shafts, and gear box, may be mounted on the tufting machine and the yarns controlled thereby directed by the yarn feed tubes to the respective groups of tufting needles for which it is desirable to control the yarn feed for conservation of yarn.

The preferred embodiments of the present invention have been disclosed by way of example and it will be understood that other modifications may occur to those skilled in the art without departing from the scope and the spirit of the appended claims.

We claim:

1. In a tufting machine including means for advancing a web of backing material, a plurality of needles mounted in an elongate needle bar reciprocable toward and away from said backing material, said needles threaded with yarn for piercing said backing material, means for feeding yarn to said needles at a speed related to the advancement of said backing material and the reciprocation of said needles, and means for shifting said needle bar laterally with respect to said backing material, the improvement comprising:

means for slowing the speed at which said yarn is fed to the outermost needle at the outwardly moving end of said needle bar as said needle bar is shifted laterally, until said needle bar returns to its original position.

2. The apparatus of claim 1, wherein said means for slowing the speed at which yarn is fed to said outermost needle comprises means for sensing lateral movement of said needle bar; and means, responsive to said sensing means, for slowing the speed at which said yarn is fed.

3. The apparatus of claim 2, wherein said needle bar shifting means shifts said needle bar laterally in a series of steps in a first direction, and alternately repeats said steps in the opposite, second direction; and wherein said means for slowing the speed at which said yarn is fed slows said yarn being fed to a first group of needles, adjacent the end of said needle bar leading in said first direction, which cover a portion of said needle bar equal in length to the first step of said needle bar from the innermost position of said needles, and thereafter slows said yarn being fed to a second group of needles, adjacent to said first group, which covers a portion of said needle bar equal in length to the second step of said needle bar, which moves said second group of needles outwardly of the innermost position of said first group of needles.

4. The apparatus of claim 3, wherein said means for slowing said yarn being fed to said needles allows said yarn being fed to said second group of needles to increase in speed responsive to said needle bar moving a step laterally in said second direction to move said second group of needles into the innermost position of said first group of needles, and allows said yarn being fed to said first group of needles to increase in speed responsive to said needle bar moving a step laterally in said second direction to move said first group of needles into its innermost position.

5. The apparatus of claim 4, wherein said means for slowing said yarn slows at the opposite end of said needle bar simultaneously in an identical but opposite manner.

6. The apparatus of claim 3, wherein said means for slowing the speed at which said yarn is being fed comprises:

a first drive shaft rotating at the normal speed at which said yarns are fed;

a second drive shaft rotating at a slower speed than said first drive shaft;

a series of first feed roller segments selectively engagable by clutches to said first drive shaft, each first feed roller corresponding to a group of needles;

a series of second feed roller segments selectively engagable by clutches to said second drive shaft, said second feed roller segments being positioned adjacent to and drivingly connected with said first feed roller segments; and clutch control means for selectively idling one of a connected pair of first and second feed roller segments while engaging the other of said pair, said yarns for each of said groups of needles passing around the first and second feed roller segments of one of said connected pairs.

7. In a tufting machine including means for advancing a web of backing material, a plurality of needles threaded with yarn and mounted in an elongate needle bar reciprocable toward and away from said backing material for penetrating said backing material, means for feeding said yarn to said needles at a first rate related to the rate of advancement of said backing material through said tufting machine and the rate of reciprocation of said needle bar, and means for shifting said needle bar laterally with respect to said backing material, the improvement comprising:

means for sensing when said needle bar has shifted a first group of a predetermined number of said needles over a no-tufting area adjacent the outer longitudinal border of said backing material wherein tufting is to be inhibited, and means responsive to said sensing means for selectively feeding yarn to said first group at a second rate slower than said first rate when said first group is positioned over said no-tufting area such that when said needles penetrate said backing, yarn is withdrawn from tufted loops in said no-tufting area when said first group penetrates said backing.

8. In a tufting machine including means for advancing a web of backing material, a plurality of needles threaded with yarn and mounted in an elongate needle bar reciprocable toward and away from said backing material for penetrating said backing material, means for feeding said yarn to said needles at a first rate related the rate of advancement of said backing material through said tufting machine and the rate of reciprocation of said needle bar, and means for shifting said needle bar laterally with respect to said backing material to successively position adjacent groups of said needles over particular areas of said backing material in unit steps of a predetermined number of said needles, the improvement comprising:

means for sensing when a particular one of a predetermined number of groups of said needles has been laterally shifted over a no-tufting area adjacent the outer longitudinal border of said backing material wherein tufting is to be inhibited;

rate changing means responsive to said sensing means for selectively changing the rate of feed of yarn to said particular one of said groups to a second rate slower than said first rate when said particular one of said groups is shifted to a position over said no-tufting area; and rate-maintaining means for maintaining the rate of feed of yarn to said particular one of said groups at said second rate while said particular one of said groups is positioned over said no-tufting area and until said particular one of said groups is laterally shifted away from said no-tufting area, whereby when said needles withdraw from said backing, yarn is withdrawn from loops formed by said particular one of said groups of needles.

9. The improvement of claim 8, wherein said sensing means comprises a predetermined number of switch means and means for actuating successive ones of said switch means as successive particular ones of said predetermined number of groups of said needles are laterally shifted over said no-tufting area.

10. The improvement of claim 8, wherein said rate changing means and said rate-maintaining means comprise:

a first time shaft rotating at said first rate, said first rate being the normal rate at which said yarn is fed;

a second drive shaft rotating at said second rate;

a first yarn roller coaxially rotatable about said first drive shaft;

first roller clutch means for selectively engaging and disengaging said first roller with said first drive shaft;

a second yarn roller coaxially rotatable about said second drive shaft;

second roller clutch means for selectively engaging and disengaging said second roller with said second drive shaft;

coupling means for maintaining the rate of rotation of said first roller and said second roller at the same rate; and clutch control means for selectively engaging said first roller clutch means and disengaging said second roller clutch means when said first rate is selected by said sensing means and for disengaging said first roller clutch means and engaging said second roller clutch means when said second rate is selected by said sensing means.

11. A method for conserving yarn in a tufting machine having a needle bar shiftable laterally with respect to a backing material to selectively position one of a plurality of groups of tufting needles over a first area of said backing material for tufting and over a second area adjacent the outer longitudinal border of said backing material wherein tufting is to be inhibited, comprising the steps of:

providing yarn to a first group of said plurality of groups of said needles at a first normal rate while said first group is positioned over said first area, penetrating said backing with said needles, shifting said needle bar laterally to position said first group over said second zone, providing yarn to said first group at a second rate of feed slower than said first rate while said first group is positioned over said second area, penetrating said backing with said needles, whereby yarn is withdrawn from said first group when said first group penetrates said backing in said second area so that tufting is inhibited in said second area.

12. A method for conserving yarn in a tufting machine having a needle bar shiftable laterally with respect to a backing material to successively position one of a predetermined number N of groups of tufting needles over a first area of said backing material for tufting and over a second area adjacent the outer longitudinal border of said backing material wherein tufting is to be inhibited, there being a first set comprising a predetermined number N-n, where n is less than or equal to N, of said groups positioned over said first area and a second set comprising n of said groups positioned over said second area at any given time, comprising the steps of:

(a) providing yarn to said first set of groups of said needles at a first normal rate while said first set is positioned over said first area, while simultaneously therewith providing yarn to said second set of groups of said needles at a second rate slower than said first rate;

(b) then penetrating said backing simultaneously with said first set and said second set;

(c) then laterally shifting said needle bar so that n is increased by one and the one of said groups of said first set which is contiguously adjacent said second set is shifted from said first set to said second set;

(d) then repeating steps (a), (b), and (c) until n equals N, whereby yarn is provided at said second rate to said second set when said second set penetrates said backing so that tufting is inhibited in said second area and yarn is conserved.

13. The method of claim 12, further comprising the steps of:

(e) laterally shifting said needle bar so that n is decreased by one and contiguously adjacent ones of said group are successively shifted from said second set to said first set; and (f) then repeating steps (a), (b) and (e) until n equals zero, whereby yarn is provided at said second rate to said second set when said second set penetrates said backing so that tufting is inhibited in said second area and yarn is conserved.

* * * * *